US006050181A

United States Patent [19]

Zenk

[11] Patent Number: 6,050,181

[45] Date of Patent: Apr. 18, 2000

[54] COMPACTOR SYSTEM

[76] Inventor: Milton J. Zenk, 919 S. Hampton St., Fairmount, Minn. 56031

[21] Appl. No.: 09/160,391

[22] Filed: Sep. 25, 1998

Related U.S. Application Data

[60] Provisional application No. 06/060,403, Sep. 30, 1997.

[51] Int. Cl.[7] ..... B30B 9/32

[52] U.S. Cl. ..... 100/215; 100/256; 100/289; 100/902

[58] Field of Search ..... 100/45, 49, 215, 100/216, 245, 256, 289, 902

[56] References Cited

U.S. PATENT DOCUMENTS

| | | | |
|---|---|---|---|
| 3,062,130 | 11/1962 | Huber et al. | 100/216 |
| 3,204,550 | 9/1965 | Swiderski et al. | 100/245 |
| 3,412,675 | 11/1968 | Killough et al. | 100/215 |
| 3,643,589 | 2/1972 | Carter | 100/49 |
| 3,916,780 | 11/1975 | Heiser | 100/902 |
| 3,960,070 | 6/1976 | McClure et al. | 100/49 |
| 4,235,164 | 11/1980 | Allen et al. | 100/245 |
| 4,240,341 | 12/1980 | Whipple et al. | 100/49 |
| 4,667,593 | 5/1987 | Kennedy | 100/215 |

FOREIGN PATENT DOCUMENTS

| | | | |
|---|---|---|---|
| 57-79100 | 5/1982 | Japan | 100/902 |
| 2-92500 | 4/1990 | Japan | 100/902 |

*Primary Examiner*—Stephen F. Gerrity
*Attorney, Agent, or Firm*—Michael S. Sherrill

[57] ABSTRACT

A compactor for crushing metal cans. The compactor includes a magazine for unattended delivery of cans to the crushing chamber.

11 Claims, 5 Drawing Sheets

COMPACTOR SYSTEM

This application claims the benefit of provisional patent application Ser. No. 60/060,403 filed Sep. 30, 1997.

FIELD OF THE INVENTION

This invention relates to compactors. More particularly, it relates to compactors for large cans.

BACKGROUND OF THE INVENTION

There has always been a need to reduce the size of metal cans once the contents are removed. Volume reduction of these empty containers is essential for many locations, such as restaurants and hospitals. A particular need for volume reduction of empty containers exists on cruise ships or naval vessels where storage space is limited and dumping of refuse into the ocean is prohibited.

Mechanized can crushers are well known in the industry. The crushers presently available employ a piston, driven by a power source and a power transmission assembly, which moves toward and away from a stationary surface to crush the can. Piston movement is governed by a manual switch controlled by an operator. The operator places an empty can between the piston face and the stationary surface, activates the switch, and the piston moves toward the stationary surface crushing the can, then moves back toward the starting position. After crushing, the can falls into a storage container or is removed manually from the crusher by the operator. The crushing cycle, lasting from about 10 to 30 seconds, is then repeated. The process as presently practiced is highly labor intensive.

There is an unmet need for a can crushing apparatus which operates unattended and is capable of crushing multiple cans without requiring manual removal and insertion of each can.

SUMMARY OF THE INVENTION

The invention is a compactor comprising a stationary strike plate, and a power source. A piston reciprocates relative to the strike plate and includes a crushing plate attached to the head of the piston with the crushing plate oriented parallel to the strike plate. A slide plate is perpendicularly attached to the upper edge of crushing plate and extends away from the strike plate. The upper edge of the crushing plate is beveled to provide a chamfered edge.

A power source and accompanying transmission means are provided for supplying the power necessary to move the piston and crush cans between the strike and crushing plates. The assembly includes a control means for activating and deactivating the power source, and a control means for limiting travel of the piston. A support means is provided between the strike plate and the crushing plate for properly positioning and holding a workpiece between the plates as the crushing plate is moved from a retracted position to an extended position thereby crushing the workpiece. When the crushing plate is in the retracted position, a crushing chamber is defined.

An aperture in the base of the frame between the strike plate and the drive plate is sized, shaped and positioned to allow a crushed workpiece to drop from between the plate members while preventing an uncrushed workpiece from falling through the aperture.

A magazine is provided above the crushing zone defined by the strike plate and the crushing plate for delivering workpieces to the crushing zone. The magazine is sized and shaped to consistently deliver properly oriented workpieces to the crushing zone (i.e., deliver #10 cans with the top of the can facing the drive plate and the bottom of the can facing the strike plate.)

DESCRIPTION OF THE PREFERRED EMBODIMENTS INCLUDING A BEST MODE

Nomenclature

Figure 1:
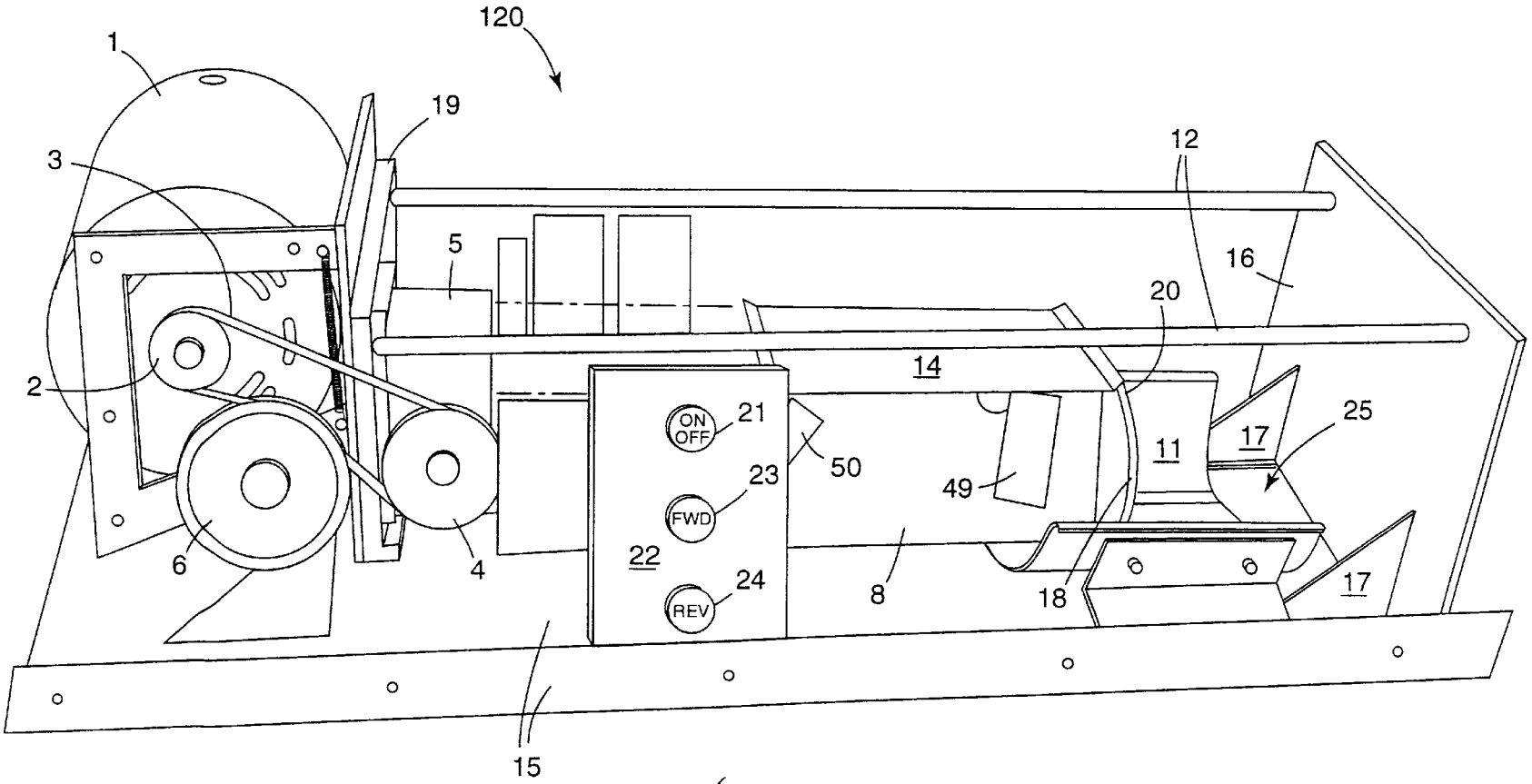
FIG. 1 is a perspective view of one embodiment of the invention with the piston in the retracted position.
Figure 2:
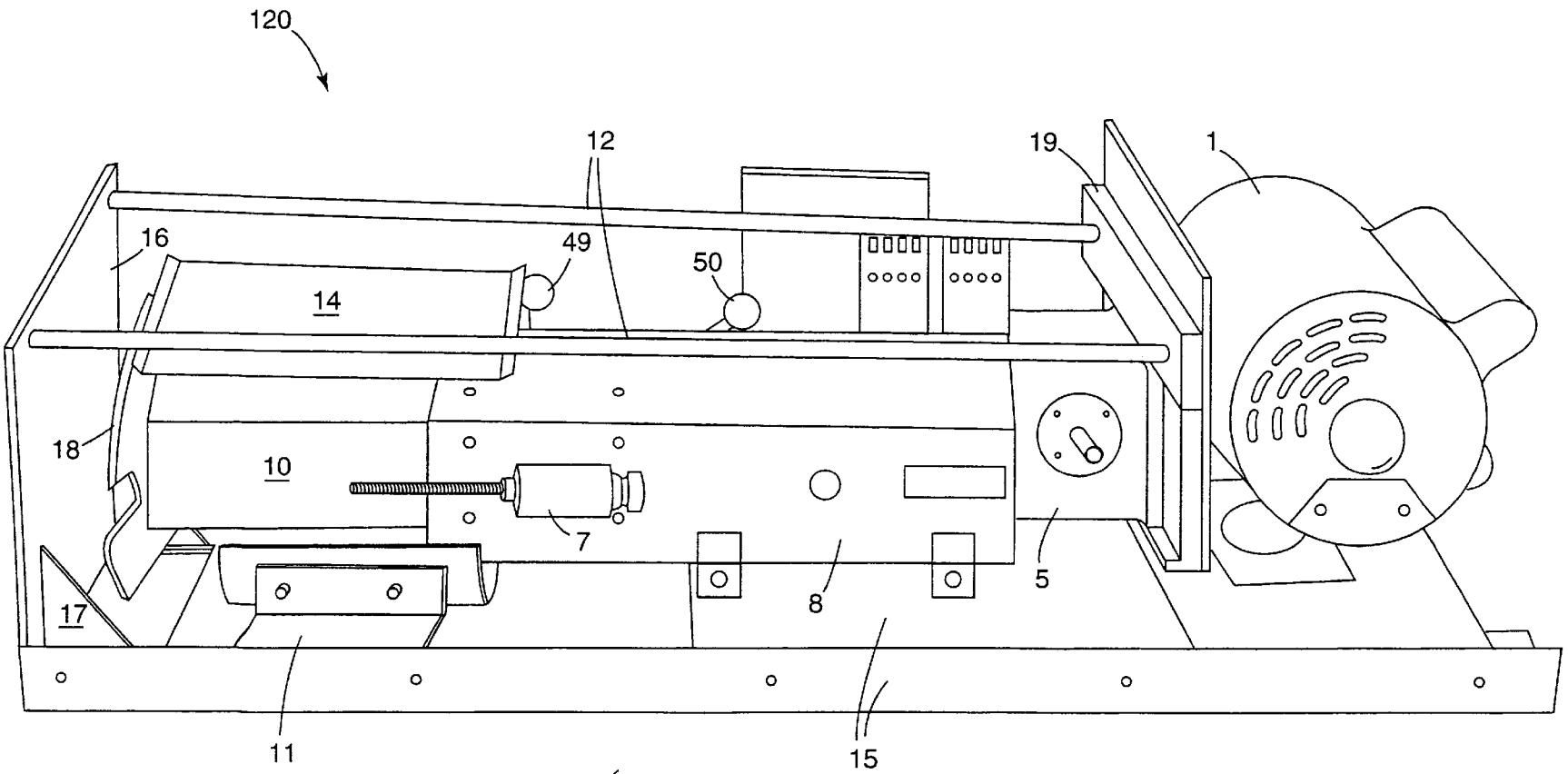
FIG. 2 is a perspective view of the invention shown in FIG. 1, shown from the opposite side of the apparatus.
Figure 3:
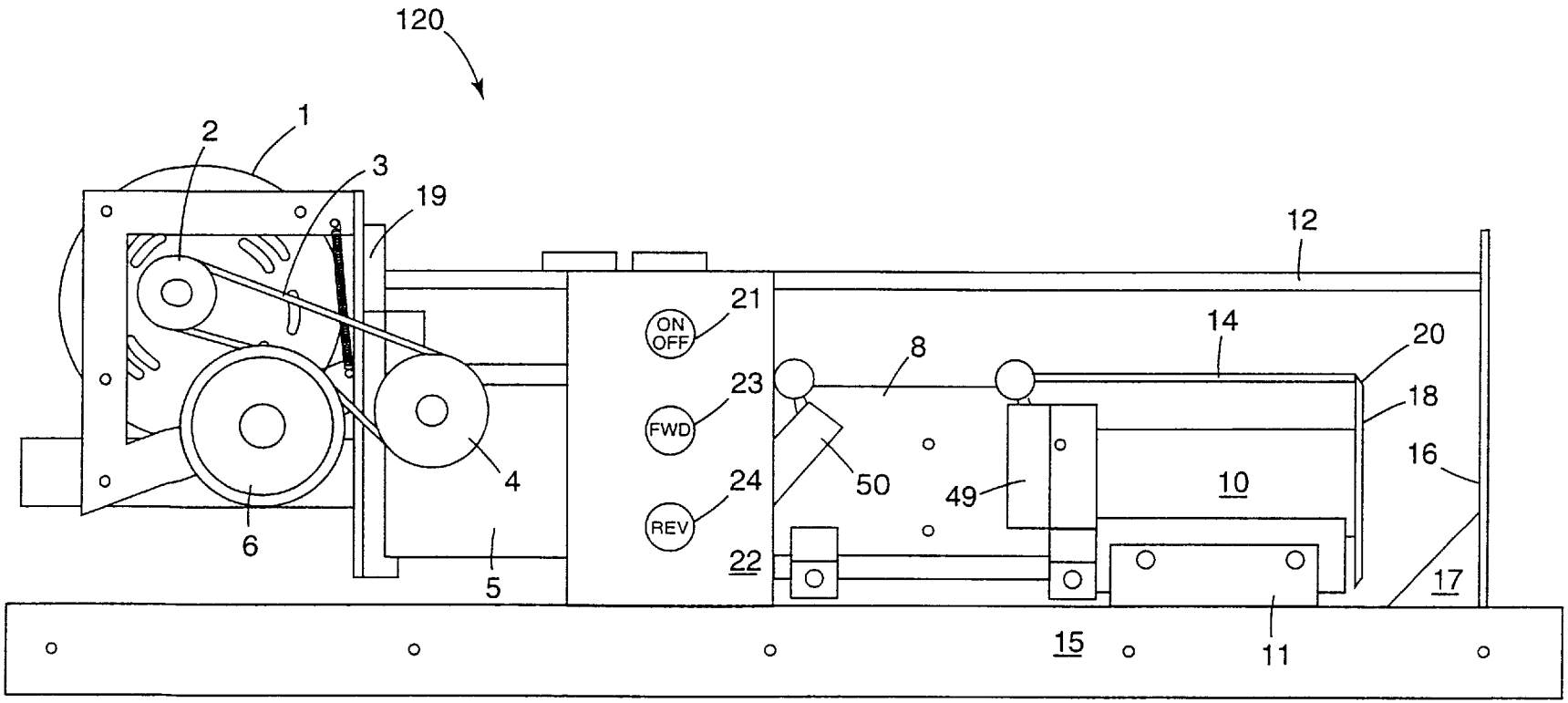
FIG. 3 is a side view of the invention shown in FIGS. 1 and 2 with the piston in the fully extended position.
Figure 4:
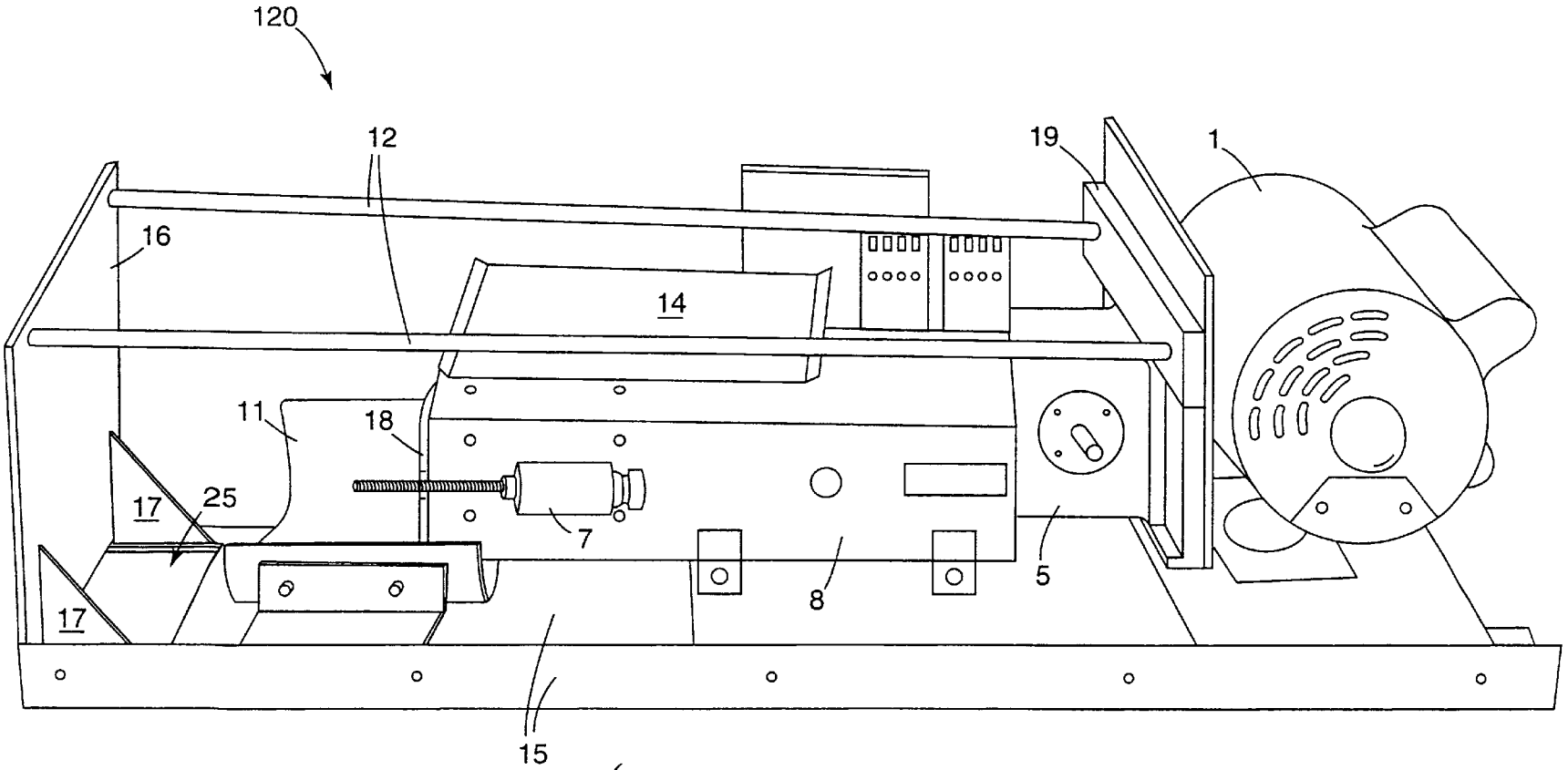
FIG. 4 is a perspective view of the invention shown in FIG. 3.

1 Power Source
2 Drive Pulley
3 Belt
4 Driven Pulley
5 Piston Drive Assembly
6 Tension Pulley
7 Sensing Means (Limit Switch)
8 Sleeve
10 Piston
11 Cradle
12 Truss Rods
14 Slide Plate
15 Base Member
16 Strike Plate
17 Bracing Members
18 Drive Plate
19 Vertical Frame Member
20 Upper Beveled Edge of Drive Plate
21 ON/OFF Switch
22 Control Panel
23 Forward Button
24 Reverse Button
25 Aperture
26 Cover
27 Top of Cover
36 Magazine
37 Inlet in Magazine
49 First Limit Switch
50 Second Limit Switch
100 Compactor
120 Operative Subassembly Construction Referring to FIGS. 1 and 2, the compactor 100 is shown with the piston 10 retracted so as to provide a crushing chamber (unnumbered) and the cover 26 removed. The operative subassembly 120 comprises a planar rectangular base member 15 for supporting the other elements. A stationary strike plate 16 is mounted perpendicularly to and positioned near one end of the base member 15. The strike plate 16 preferably has a surface area larger than the area of the workpiece (not shown) to be crushed so that the entire periphery of the workpiece is contacted by the strike plate 16 while the workpiece is being crushed. The strike plate 16 may be supported in position against the force exerted by movement of the piston 10 by triangular side bracing members 17 connected to both a base member 15 and the stationary plate 16. A piston drive assembly 5 is secured near the center of the base member 15 and attached to a piston 10 for linearly reciprocating the piston 10 towards and away from the stationary strike plate 16. A preferred piston drive assembly 5 is a ball screw actuator.

The piston 10 is surrounded by a stationary sleeve 8 for guiding linear movement of the piston 10 The sleeve 8 preferably has a square cross-sectional area and is lined with a plastic material for reducing friction between the reciprocating piston 10 and the stationary sleeve 8.

A crushing plate 18 is secured to the head (unnumbered) of the piston 10 exterior the sleeve 8. The crushing plate 18 is oriented parallel to the strike plate 16 and defines a crushing chamber between the crushing plate 18 and the strike plate 16. As with the strike plate 16, the crushing plate 18 preferably provides a surface area larger than the area of the workpiece (not shown) to be crushed so that the entire periphery of the workpiece is contacted by the crushing plate 18 while the workpiece is being crushed.

A generally rectangular slide plate 14 is securely attached, such as by welding, to the upper edge (unnumbered) of the crushing plate 18. The slide plate 14 extends perpendicular to the crushing plate 18 away from the stationary strike plate 16. The slide plate 14 is positioned over sleeve 8 and travels back and forth with the piston 10 for preventing a workpiece stacked above the workpiece within the crushing chamber from falling behind the crushing plate 18.

The upper edge 20 of the crushing plate 18 is chamfered or beveled to prevent the crushing plate 18 from catching the lower edge of a subsequent workpiece stacked above the workpiece within the crushing chamber. Workpieces which have been partially crushed in this manner frequently become wedged within the apparatus and must be manually removed. The beveled edge forces the subsequent workpiece to rise over the top of the crushing plate 18 where the workpiece can slide atop the slide plate 14 as the workpiece within the crushing chamber is crushed.

A power source 1 is mounted on the base member 15 and connected via a power transmission means 2, 3, 4 to the piston drive assembly 5. A preferred power source 1 is an electric motor. A suitable power transmission means includes a drive pulley 2 attached to the spindle (unnumbered) of the motor 1, a driven pulley 4 attached to the piston drive assembly 5, a belt 3 surrounding both the drive pulley 2 and the driven pulley 4 connected to a gear box assembly (unnumbered) for transferring rotational motion from the motor to the piston drive assembly 5, a tensioning pulley 6 is biased into the path of the belt 3 between the drive pulley 2 and the driven pulley 4 for maintaining proper tensioning of the belt 3.

Structural stability is enhanced by a pair of truss rods 12 connected at one end to the top comers (unnumbered) of the stationary strike plate 16 and connected at the other end to a vertical frame member 19 extending up from the base members 15 between the piston drive assembly 5 and the power source 1.

There is a power control means (unnumbered) to activate and deactivate the electric motor 1, as well as a piston control means (unnumbered) to control the direction and length of the stroke of the piston 10. The power source control means 21 is an ON/OFF switch 21 mounted on a control panel 22. The piston control means (unnumbered) is a pair of limit switches 49 and 50 positioned near the traveling piston body member, as well as forward 23 and reverse 24 buttons located on the control panel. The first limit switch 49 governs the maximum extension of the piston 10, while the second limit switch 50 governs the minimum extension (i. e., retraction position) of the piston 10.

A cradle 11 secured to the base member 15 is positioned between the strike plate 16 and the crushing plate 18 just below the crushing plate 18 to support a workpiece within the crushing chamber in proper position relative to the plates 16 and 18. When the workpieces are #10 cans, the cradle 11 preferably a concave plate having a radius of curvature matched to the curvature of a round crushing plate 18 so as to minimize any gaps between the inner surface (unnumbered) of the cradle and the periphery of the crushing plate 18 as the drive plate 18 reciprocates along the length of the cradle 11.

An aperture 25 is provided in the base 15 proximate the strike plate 16. The aperture 25 is sized, shaped and positioned to allow a crushed workpiece to drop from between the plates 16 and 18 while preventing an uncrushed workpiece from falling through the aperture 25.

As seen in FIG. 2, a sensing means, in the form of a flexible arm limit switch 7, extends within the crushing chamber to detect the presence of a workpiece within the crushing chamber. The sensing means 7 initiates a crushing cycle (i.e., reciprocation of the piston 10 from a fully retracted position to a fully extended position and back to a fully retracted position) when it senses a workpiece within the crushing chamber.

Figure 5:
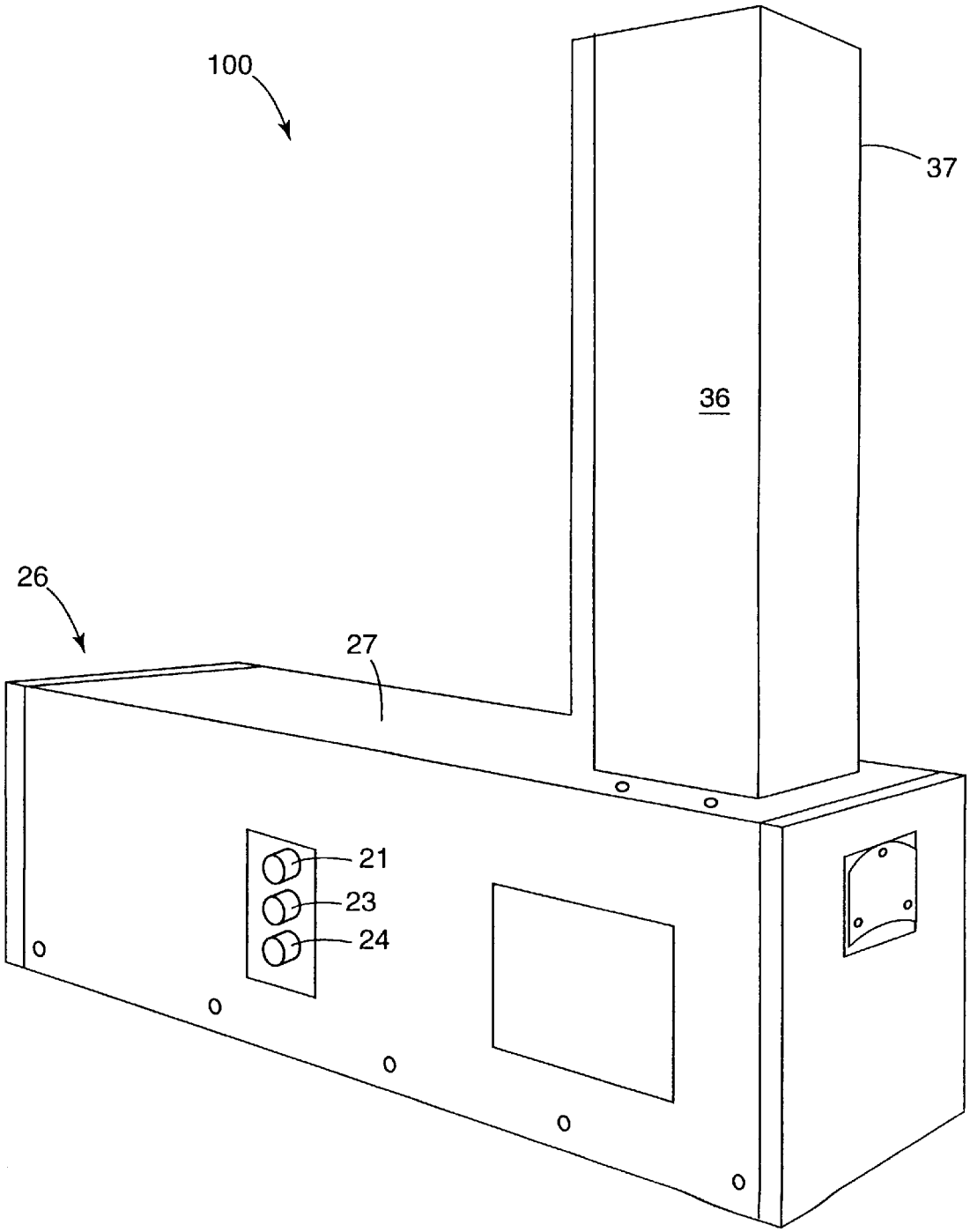
FIG. 5 is a perspective view of the invention shown in FIGS. 1–4 with the protective cover and magazine positioned over the apparatus.

As seen in FIG. 5, the compactor 100 is fitted with a removable cover 26 which conforms to the shape of the base member 15 and encloses the operative subassembly 120. The cover 26 is a rectangular housing having a top 27 and sides 28 made of a stainless steel alloy.

A magazine or feed chute 36 is vertically mounted atop the cover 26 over a suitably sized and shaped aperture (not shown) through the top 27 of the cover 26. The magazine 36 has an open end (unnumbered) which is releasably secured over the aperture in the top 27 of the cover 26. The magazine 36 is positioned directly over the crushing chamber for feeding workpieces to the crushing chamber. The magazine 36 is sized to hold a plurality of workpieces (e.g., 3 to 7 #10 cans) with the top and bottom of the cans oriented towards the plates 16 and 18. The cans are loaded into the magazine 36 through a suitably sized and shaped inlet 37 proximate the top (unnumbered) of the magazine 36. The inlet 37 may be provided through a vertical side (unnumbered) or through the top (unnumbered) of the magazine 36.

Operation

To operate the compactor 100, an operator sets the piston 10 to the fully retracted position and fills the magazine 36 with uncrushed workpieces. The first workpiece falls into the crushing chamber between the strike plate 16 and the crushing plate 18. The balance of the workpieces are stacked one atop the next within the magazine 36 in contact with the workpieces immediately above and below.

The operator presses the FORWARD button 23 and the piston 10 begins to move the crushing plate 18 towards the stationary plate 16 and into contact with the workpiece within the crushing chamber. As the crushing plate 18 begins to crush the workpiece within the crushing chamber, the bottom edge of the next workpiece in the stack is contacted by the upper beveled edge 20 of the crushing plate 18 and is forced upward until the workpiece is pushed out of the path of the crushing plate 18. This workpiece is then supported above the piston 10 and the crushing chamber by the slide plate 14.

The crushed workpiece within the crushing chamber falls through the aperture 25 in the base member 15 once the crushing plate 18 reverses direction. When the piston 10 returns to the fully retracted position, the next workpiece (i.e., the workpiece contacted by the beveled upper edge of the crushing plate 18) drops into the crushing chamber and the crushing cycle repeated. The crushing cycle is repeated until all the workpieces in the magazine 36 are crushed and the workpiece sensing limit switch 7 senses the absence of a workpiece within the crushing chamber.

While the invention has been particularly shown and described with reference to a preferred embodiment thereof, it will be understood by those skilled in the art that various changes in the form and details may be made without departing from the spirit and scope of the invention.

I claim:

1. A compactor system assembly comprising:

(a) a planar base member for mounting components thereupon;

(b) a stationary plate member secured perpendicularly to said planar base member;

(c) a piston driver member secured to said base member with a traveling piston body member attached thereto, said piston body member traveling perpendicularly toward and away from said stationary plate member and traveling parallel to said base member;

(d) a crushing plate member secured to said traveling piston body member, said crushing plate member oriented perpendicularly to said base member and parallel to said stationary plate member, said crushing plate member having a chamfered edge opposite said base member with a slide plate member attached to said chamfered edge, said slide plate member extending in an orientation opposite said stationary plate member;

(e) whereby the space between said crushing plate and said stationary plate member defines a crushing chamber when said crushing plate and said piston driver member are in a retracted position;

(f) a power source to power said piston driver member;

(g) transmission means to transfer power from said power source to said piston driver member;

(h) control means for activating and deactivating said power source, and control means for limiting travel of said piston driver member;

(i) support means for positioning a can workpiece between said stationary plate member and said crushing plate member;

(j) an aperture in said base member positioned to allow a crushed can workpiece to exit from between said stationary plate member and said crushing plate member;

(k) a can storage means to deliver an uncrushed can to said support means between said stationary plate member and said crushing plate member, said storage means sized to accept and deliver cans with can ends parallel to said stationary plate member and said crusher plate member; and (l) whereby the junction between said can storage means and said crushing zone defines an open passageway allowing the unimpeded movement of cans following a crushing cycle.

2. An apparatus according to claim 1 wherein said crushing plate member is generally round.

3. An apparatus according to claim 2 wherein said support means for positioning a can workpiece is a curved plate member with radius of curvature larger than the round crushing plate member.

4. An apparatus according to claim 1 wherein said power source comprises an electric motor.

5. An apparatus according to claim 1 wherein said transmission means comprises in combination a pulley, a belt, and a piston drive assembly.

6. An apparatus according to claim 1 wherein said control means for limiting travel of said piston driver member comprises a pair of limit switches attached thereto.

7. An apparatus according to claim 1 wherein said can storage means comprises a generally rectangular can storage magazine positioned above said can support means, said magazine containing at least two apertures therein, a first aperture to deliver an uncrushed can to said support means, and a second aperture to receive uncrushed cans.

8. An apparatus according to claim 1 further comprising a stationary hollow drive tube member surrounding said piston body member.

9. An apparatus according to claim 1 further comprising a pair of truss rod members fastened between said stationary plate member and a vertical frame member.

10. An apparatus according to claim 1 further comprising a removable cover means conforming to said planar base member and enclosing the assembly members mounted thereon.

11. An apparatus according to claim 10 wherein said can storage means is mounted to said cover means and positioned directly above said can support member.

* * * * *

UNITED STATES PATENT AND TRADEMARK OFFICE

CERTIFICATE OF CORRECTION

PATENT NO. : 6,050,181
DATED : April 18, 2000
INVENTOR(S) : Zenk

It is certified that error appears in the above-identified patent and that said Letters Patent is hereby corrected as shown below:

Column 4,
Line 8, "cradle 11" should be -- cradle 11 is --
Line 13, "drive" should be -- crushing --

Signed and Sealed this

Fourth Day of December, 2001

*Attest:*

Nicholas P. Godici

*Attesting Officer*

NICHOLAS P. GODICI
*Acting Director of the United States Patent and Trademark Office*